United States Patent [19]

Tietjens

[11] 4,347,662

[45] Sep. 7, 1982

[54] SHAVING APPARATUS

[75] Inventor: Eduard W. Tietjens, Drachten, Netherlands

[73] Assignee: U.S. Philips Corporation, New York, N.Y.

[21] Appl. No.: 259,799

[22] Filed: May 4, 1981

[30] Foreign Application Priority Data

Jun. 25, 1980 [NL] Netherlands ..... 8003669

[51] Int. Cl.[3] ..... B26B 19/42

[52] U.S. Cl. ..... 30/34.2; 30/43.6

[58] Field of Search ..... 30/34.2, 43.6

[56] References Cited

U.S. PATENT DOCUMENTS

| | | | |
|---|---|---|---|
| 4,223,437 | 9/1980 | Boiten | 30/43.6 |
| 4,272,884 | 6/1981 | Tietjens | 30/43.6 |
| 4,275,497 | 6/1981 | Engelhardt | 30/34.2 |
| 4,283,849 | 8/1981 | Engelhardt | 30/43.6 |

*Primary Examiner*—Jimmy C. Peters

*Attorney, Agent, or Firm*—Thomas A. Briody; William J. Streeter; Rolf E. Schneider

[57] ABSTRACT

There is provided a shaving apparatus having a shear plate formed with hair-entry apertures and a cutting unit associated with and drivable relative to the shear plate. The cutting unit comprises a cutting element having cutters, a hair-pulling blade being associated with each cutter and positioned in front of the same in the direction of driving the cutting unit. To enable the shaving apparatus to be operated at a high speed, the hair-pulling blades are elastically coupled to the cutting element whereby each hair-pulling blade is movable, upon driving of the cutting unit, toward and into contact with its associated cutter upon contact of the hair-pulling blade with a hair. Each hair pulling blade is normally spaced from its associated cutter throughout their respective lengths.

1 Claim, 8 Drawing Figures

SHAVING APPARATUS

This invention relates to a shaving apparatus having a shear plate with hair-entry apertures and a cutting unit which is movable relative to the shear plate, which cutting unit comprises a central body with cutters, each cutter being provided with a hair-pulling blade which precedes said cutter viewed in the direction of driving.

Such a shaving apparatus is known from, for example, U.S. Pat. No. 3,962,784.

It is an object of the present invention to provide such a shaving apparatus in which the cutting unit can be driven with a high speed and the invention is characterized in that the hair-pulling blades are elastically coupled to the central body, a hair-pulling blade being movable over a limited distance relative to the central body in a direction opposite to the direction of driving.

A special embodiment is characterized in that between a hair-pulling blade and its associated cutter there is arranged a resilient element.

A further special embodiment is characterized in that the hair-pulling blade together with the associated cutter is elastically coupled to the central body.

The invention will now be explained in detail in connection with the accompanying drawings, in which.

Figure 3:
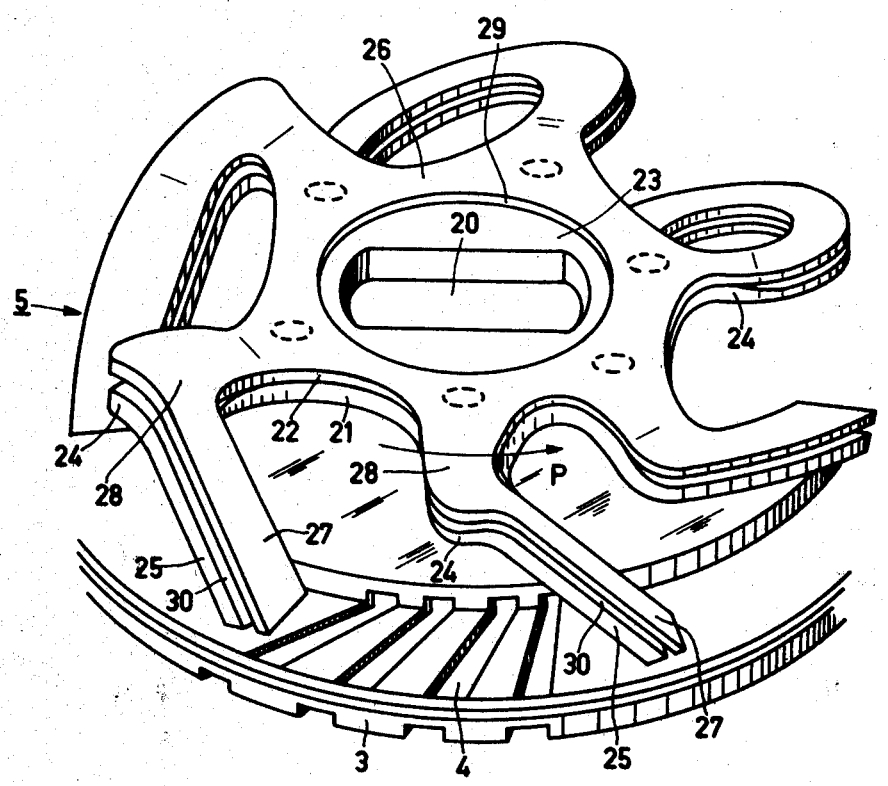
FIG. 3 is a perspective view of the cutting unit and a part of the shear plate as used in the shaving apparatus shown in FIGS. 1 and 2.
Figure 4:
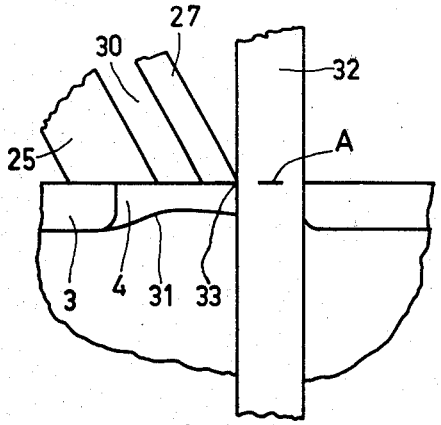
Figure 5:
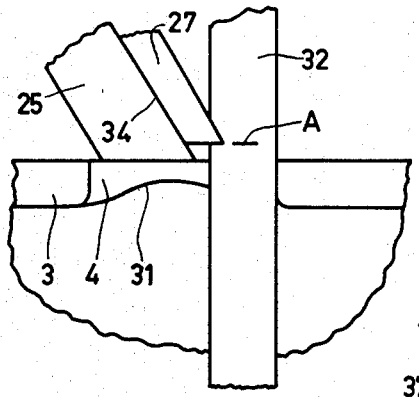
Figure 6:
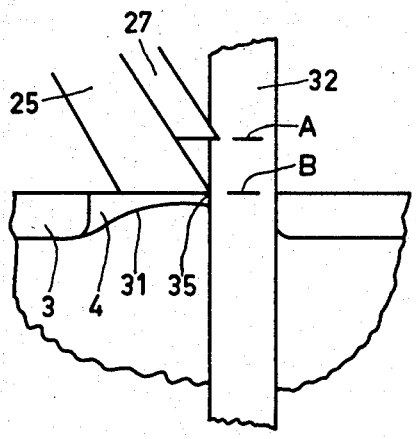

FIGS. 4, 5 and 6 schematically represent a detail of the cutting unit shown in FIG. 3 and illustrate the operation of a hair-pulling blade.

Figure 7:
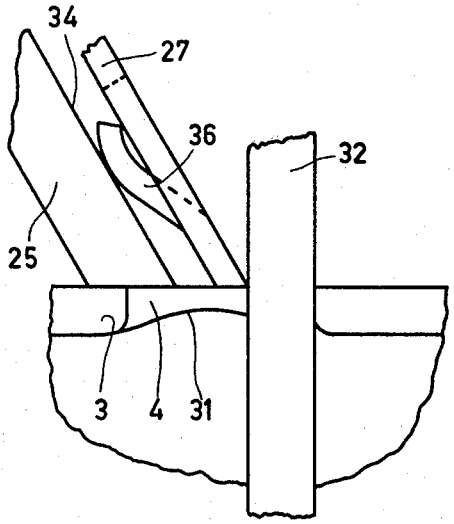
Figure 8:
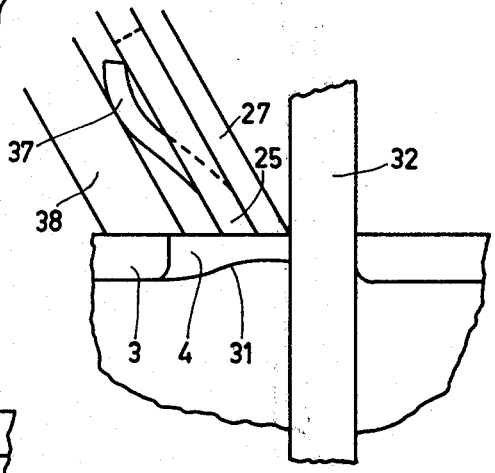

FIGS. 7 and 8, in the same way as FIG. 4, schematically show variants of the cutting unit shown in FIGS. 3 to 6.

Figure 1:
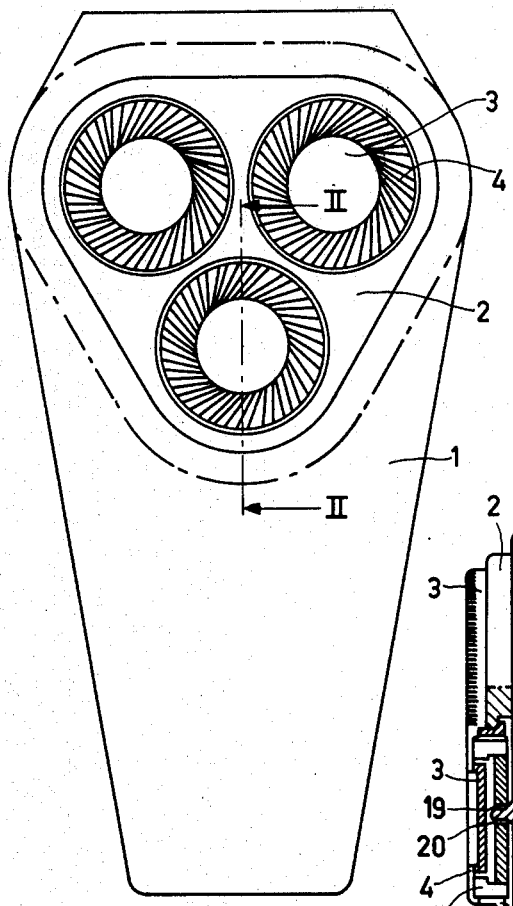
FIG. 1 is an elevation of a shaving apparatus having three shear plates.
Figure 2:
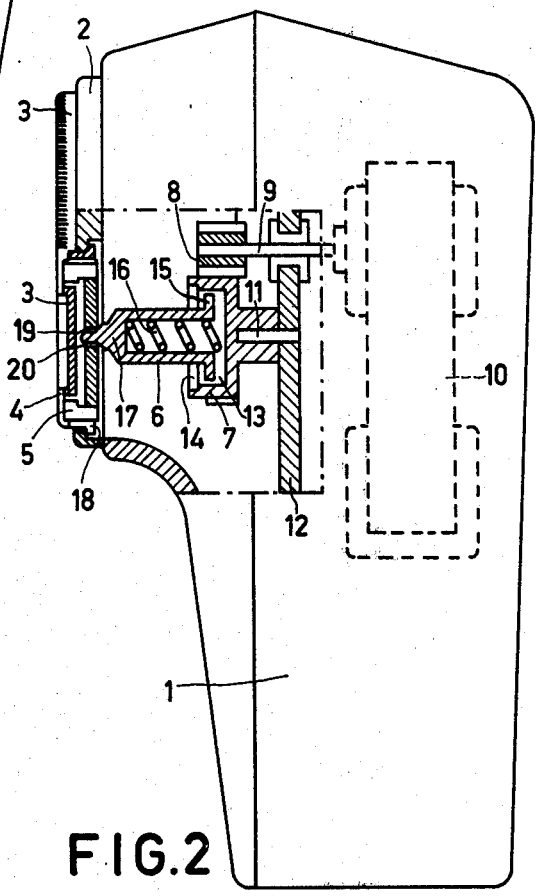
FIG. 2 shows the shaving apparatus of FIG. 1 in side view and partly in a sectional view taken on the line II—II of FIG. 1.

The shaving apparatus shown in FIGS. 1 and 2 comprises a housing 1, of which a part forms a shear plate holder 2 for three shear plates 3. The shear plates 3 are formed with hair-entry apertures 4.

As shown in the partial sectional view of FIG. 2 a cutting unit 5 is arranged on the inner side of a shear plate 3. This cutting unit 5, which for the sake of clarity is only represented schematically in FIG. 2, comprises a cutting element and hair-pulling blades and is shown on an enlarged scale in FIG. 3.

The cutting unit 5 is coupled to the electric motor 10 by means of the hollow spindle 6 (FIG. 2), the gear wheels 7 and 8 and the spindle 9, so that the cutting unit is rotatable relative to the associated shear plate 3. The gear wheel 7 is rotatably journalled on a pin 11, which is mounted in a mounting plate 12. The gear wheel 7 is formed with a recess 13, which is closed by a cover plate 14. The flange 15 on the end of the hollow spindle 6 is fitted in this recess. By giving the flange 15 a non-circular, for example square, shape and by correspondingly shaping the recess 13 a coupling is obtained for transmitting the rotary movement of the gear wheel 7 to the spindle 6. The spring 16, which for its greater part is situated in the hollow spindle 6 and is compressed between the hollow spindle 6 and the gear wheel 7, exerts a force on the spindle 6 in the direction of the cutting unit 5. As the cylindrical portion 17 of the spindle 6 engages with the cutting unit 5, said force is exerted on the cutting unit and via the cutting unit on the shear plate 3, so that the shear plate is urged against the shear plate holder 2 by means of its rim 18. Owing to external forces, as may occur during use of the shaving apparatus, the shear plate 3 together with the cutting unit 5 and the spindle 6 can be pressed inwards against the action of the spring 16.

The coupling for transmitting the rotary movement between the spindle 6 and the cutting unit 5 is obtained by providing the spindle 6 with an end 19 of rectangular cross-section. This end 19 engages with a corresponding rectangular coupling aperture 20 in the cutting unit 5.

The coupling to the electric motor 10 described in the foregoing is identical for the three cutting units of the apparatus shown in FIGS. 1 and 2, the three gear wheels 7 meshing with a single centrally arranged gear wheel 8 on the motor spindle 9.

The cutting unit 5 (FIG. 3) comprises a cutting element 21 and a hair-pulling element 22.

The cutting element 21 is constituted by a central body 23, which at its circumference is provided with arms 24 on whose ends the cutters 25 are situated. The central body 23 is formed with the coupling aperture 20.

The hair-pulling element 22 is made of a resilient sheet material and comprises a central plate-shaped portion 26 to which the hair-pulling blades 27 are connected by means of the connecting arms 28. The central plate-shaped portion 26 has a central opening 29. The central plate-shaped portion 26 of the hair-pulling element 22 is positioned against the central body 23 of the cutting element 21 and the two parts can be secured to each other in known manner, such as by glueing, welding or by bolts. Both the cutters 25 and the hair-pulling blades 27 are formed flat plate-shaped parts. Between a cutter 25 and a hair-pulling blade 27 a slot-like clearance 30 exists. Owing to the elasticity of the connecting arms 28 the hair-pulling blades 27 are elastically coupled to the central body 23. This elasticity enables each hair-pulling blade 27 to move over a limited distance relative to its associated cutter 25. This movement takes place in a direction substantially away from the shear plate 3 and in a direction opposite to the direction of driving P, that is, towards the associated cutter.

The operation of the cutting unit will be described with reference to FIGS. 4 to 6, which schematically represent a side view of a cutter 25 and its associated hair-pulling blade 27. Moreover, a part of the shear plate 3 with a hair-entry aperture 4 is shown. The shear plate 3 is positioned against a skin portion 31 and its associated hair 32 projects through the aperture 4. Owing to the movement of a cutter 25 and hair-pulling blade 27 in the direction of driving P the hair 32 will soon meet the sharp edge 33 of the hair-pulling blade 27 at the location A. The edge 33 has a sharpness such that it will slightly penetrate into the hair 32 without severing it. The reaction force exerted on the hair-pulling blade 27 by the hair 32 will cause the blade to be moved towards the cutter 25 in a direction opposite to P against the action of the resilient arm 28 (FIG. 3). When the hair-pulling blade 27 subsequently contacts the inclined guide surface 34 at the front of the cutter 25 (FIG. 5) the reaction forces between the cutter and the hair-pulling blade will cause the hair-pulling blade 27 to be moved along said guide surface away from the shear plate 3. The hair 32 is moved along by the hair-pulling blade 26 and is slightly pulled up from the skin 31 until the cutting edge 35 of the cutter 25 has reached the hair at the location B (FIG. 6). The hair 32 is then severed by the co-operation of the cutter 25 and the shear plate 3. Thus, a portion of the hair 32 is severed whose length is longer by an amount corresponding to the distance between A and B than the portion which would be cut without a hair-pulling blade, so that a better shaving result is obtained.

Owing to the comparatively small mass of the hair-pulling element 22 relative to the complete cutting unit 5 and the ability of the hair-pulling blades to move over some distance in a direction opposite to P relative to the rest of the cutting unit, the reaction forces between the hair 32 and the hair-pulling blade 27 are spread over a longer period than if the hair-pulling blade were positioned directly against the cutter. The resulting reaction forces are therefore smaller, so that the risk of the hair being severed by the hair-pulling blade before it can be pulled up is reduced. Thus, higher driving speeds for the cutting unit may be selected, so that a less costly drive mechanism can be obtained.

In the embodiment shown in FIG. 7 the hair-pulling blade 27 is provided with a resilient tongue 36 which engages the guide surface 34 of the cutter 25.

In the embodiment shown in FIG. 8 the hair-pulling blade 27 engages the associated cutter 25. The cutter 25 has a resilient tongue 37 which bears against a cutter support 38.

The hair-pulling blades, the cutters and the cutter supports of the embodiments shown respectively in FIGS. 7 and 8 may again be formed from sheet material, as in the embodiment shown in FIG. 3.

The supports 38 of the embodiment shown in FIG. 8 then form part of a central body which only serves for supporting the cutters and the hair-pulling blades and does not have any cutting action. However, in this embodiment the parts 25 and 27 may both be constructed as hair-pulling blades and the part 38 as the cutter.

The operation of the embodiments shown in FIGS. 7 and 8 is further basically identical to that of the embodiment shown in FIG. 3.

What is claimed is:

1. A shaving apparatus having a shear plate provided with hair-entry apertures and a cutting unit associated with and drivable relative to the shear plate; said cutting unit comprising a cutting element having a central body, cutters extending from said central body toward the shear plate, a hair-pulling element having a central portion, hair-pulling blades respectively associated with and movable relative to the cutters in directions respectively away from and toward the shear plate, each hair-pulling blade, with reference to the direction of driving the cutting unit, being positioned in front of its associated cutter, resilient arms respectively connecting the hair-pulling blades to said central portion, and means to secure said central portion to said central body to effect elastic coupling of the hair-pulling blades to the central body, each hair-pulling blade being normally spaced from its associated cutter throughout their respective lengths and, upon driving of said cutting unit, being movable toward and into contact with its associated cutter by reason of said elastic coupling upon contact with the hair-pulling blade with a hair.

* * * * *